US006586382B1

(12) United States Patent
Scialla et al.

(10) Patent No.: US 6,586,382 B1
(45) Date of Patent: Jul. 1, 2003

(54) PROCESS OF BLEACHING FABRICS

(75) Inventors: Stefano Scialla, Rome (IT); Pierre Antoine Dresco, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/806,883

(22) PCT Filed: Oct. 13, 1999

(86) PCT No.: PCT/US99/24022

§ 371 (c)(1), (2), (4) Date: Apr. 5, 2001

(87) PCT Pub. No.: WO00/23554

PCT Pub. Date: Apr. 27, 2000

(30) Foreign Application Priority Data

Oct. 19, 1998 (EP) ..... 98203513

(51) Int. Cl.[7] ..... C11D 3/395
(52) U.S. Cl. ..... 510/318; 510/309
(58) Field of Search ..... 510/367, 309, 510/318

(56) References Cited

U.S. PATENT DOCUMENTS 4,079,015 A 3/1978 Paucot et al.

FOREIGN PATENT DOCUMENTS

| | | | |
|---|---|---|---|
| EP | 090310 | A1 | 10/1983 |
| EP | 404293 | A2 | 12/1990 |
| EP | 432776 | A2 | 6/1991 |
| EP | 751214 | A1 | 1/1997 |
| EP | 751214 | A1 | 9/1997 |
| EP | 794245 | A1 | 9/1997 |
| EP | 839903 | A1 | 5/1998 |
| EP | 905227 | A1 | 3/1999 |
| GB | 2179365 | A | 3/1987 |
| JP | 2088699 | A * | 3/1990 |

* cited by examiner

*Primary Examiner*—Yogendra N. Gupta
*Assistant Examiner*—John M Petruncio
(74) *Attorney, Agent, or Firm*—James F. McBride; Jason J. Camp; Kim W. Zerby

(57) ABSTRACT

The present invention relates to a process of treating a fabric with a neat bleaching composition comprising a peroxygen bleach and a high molecular weight polymer. Such bleaching composition provides bleaching benefits and enhanced fabric safety. The present invention also relates to a method of reducing the evaporation of a bleaching composition's solvent.

12 Claims, No Drawings

PROCESS OF BLEACHING FABRICS

CROSS REFERENCE TO RELATED APPLICATIONS

This application claims the benefit of PCT International Application Ser. No. PCT/US99/24022, filed Oct. 13, 1999, which in turn claims priority to EP 98203513.1, filed Oct. 19, 1998.

TECHNICAL FIELD

The present invention relates to a process of treating fabrics with liquid bleaching compositions. Said compositions are suitable for use in various laundry applications, e.g., as laundry pretreater. More particularly, the compositions herein are suitable for use on various fabrics to provide stain removal and bleaching performance.

BACKGROUND

Bleach-containing compositions for bleaching fabrics, are well known in the art.

Liquid peroxygen bleach-containing compositions have been extensively described in the art, especially in laundry applications as laundry detergents, laundry additives or laundry pretreaters.

Indeed, it is known to use such peroxygen bleach-containing compositions in laundry pretreatment applications to boost the removal of encrusted stains/soils and "problem" stains, such as grease, coffee, tea, grass, mud/clay-containing soils, which are otherwise particularly difficult to remove by typical machine washing.

However, a drawback associated with such bleach-containing compositions is that said compositions may damage fabrics treated therewith, more particularly said compositions may cause color damage of dyed fabrics and/or loss of tensile strength of the fabric fibers treated with said compositions. Especially when said compositions are used in pretreatment applications under stressed conditions, e.g., when applied directly onto the fabric and left to act onto said fabric for prolonged periods of time before washing said fabrics. When applying said compositions for prolonged periods of time, said compositions will dry on said fabric before washing said fabrics. It is believed that said drying of the bleaching composition is responsible for damage caused to the treated fabrics.

It is thus an object of the present invention to provide good fabric safety, by reducing colour fading and/or loss of tensile strength, when treating, preferably pretreating, fabrics with peroxygen bleach-containing compositions. The above is true especially in applications where said compositions are left into contact with said fabrics for prolonged periods of time, before the fabrics are washed.

When pretreating fabrics with compositions comprising a peroxygen bleach like hydrogen peroxide, it has been found that the presence of metal ions such as copper and/or iron and/or manganese on the surface of fabrics produces fabric damage resulting in color damage and/or loss of tensile strength of the fabric fibres. It is speculated that the presence of said metal ions catalyse the radical decomposition of peroxygen bleaches. The radical decomposition reaction occurs on the surface of the fabrics and is believed to cause fabric damage. The evaporation of solvent, e.g., water, from a bleaching composition occurs during a prolonged laundry pretreatment process, for example where a fabric has been pretreated with a bleaching composition and said composition has been allowed to dry. Evaporation of the solvent results in an increase in the peroxygen bleach concentration on the fabric. The increased peroxygen bleach concentration and the presence of said metal ions results in said radical reaction becoming highly activated and thus, increasing fabric damage.

We have found that it is essential to reduce solvent evaporation in the pretreatment environment to keep the concentration of the peroxygen bleach on the treated fabrics low and thereby providing good fabric safety, more particularly the reduction of colour fading and/or loss of tensile strength.

It has now been found that this can be achieved by using in a peroxygen bleach-containing composition an ingredient reducing the evaporation of the solvent contained in said composition. Said ingredient acts as a fabric protective agent in said composition. More particularly, it has been found that the use of said ingredient in a laundry treatment process results in reduced fabric damage, more particularly reduced colour fading and/or loss of tensile strength when such a bleaching composition is used in said laundry treatment process.

Advantageously, the bleaching compositions as described herein also provide excellent stain removal performance on various stains including greasy stains and excellent bleaching performance. Indeed, it has been found that said bleaching compositions have an excellent bleaching performance.

More particularly, the compositions of the present invention provide excellent bleach performance when used in any laundry application, e.g., as a laundry detergent or a laundry additive, and especially when used as a laundry pretreater, or even in other household applications like in hard surface cleaning applications.

BACKGROUND ART

Bleaching compositions comprising peroxygen bleach and polymers as described herein are well known in the art. EP-A-0 432 776 discloses the use of high molecular weight crosslinked and non-crosslinked homopolymers of acrylic acid or high molecular weight crosslinked and non-crosslinked copolymers of acrylic acid and alkyl acrylates in liquid compositions comprising hydrogen peroxide as thickeners and stabilising agents. However, the use of said polymers as fabric protective agents in peroxygen bleach-containing compositions is not disclosed.

SUMMARY OF THE INVENTION

The present invention encompasses a process of treating a fabric which comprises the steps of contacting said fabric with a bleaching composition, in its neat form, wherein said bleaching composition comprises a peroxygen bleach and an ingredient reducing the evaporation of the solvent contained in said composition.

The present invention further encompasses the use in a peroxygen bleach-containing composition of an ingredient reducing the evaporation of the solvent contained in said composition to treat fabrics, whereby colour fading and/or loss of tensile strength is reduced.

In a preferred embodiment said ingredient reducing the evaporation of the solvent contained in said composition is a high molecular weight homopolymer of acrylic acid and/or a high molecular weight copolymer of acrylic acid and other comonomers, preferably alkyl acrylates.

In another preferred embodiment of the present invention the treated fabrics are coloured.

In another preferred embodiment of the present invention the treated fabrics are delicate fabrics such as silk, wool and the like.

DETAILED DESCRIPTION OF THE INVENTION

The Liquid Bleaching Composition

The bleaching compositions according to the present invention are liquid compositions as opposed to a solid or a gas. As used herein "liquid" includes "pasty" compositions.

Preferred compositions of the present invention have a viscosity of 1 cps or greater, more preferably of from 10 to 2000 cps, and still more preferably of from 20 to 1500 cps at 20° C. when measured with a Brookfield viscometer at 50 rpm with a spindle n°3.

The liquid bleaching compositions according to the present invention comprise a solvent. Any solvent known to those skilled in the art of formulating liquid bleaching compositions may be used. Preferably said bleaching compositions are aqueous and therefore, comprise water as solvent, preferably in an amount of from 60% to 98%, more preferably of from 80% to 97% and most preferably 85% to 97% by weight of the total composition.

The liquid compositions according to the present invention preferably have a pH of up to 9, more preferably from 2 to 7, and most preferably from 2 to 6. In a preferred embodiment the compositions according to the present invention are formulated in the neutral to the acidic pH range, which contributes to the chemical stability of the compositions and to the stain removal performance of the compositions. The pH of the compositions may be adjusted by any acidifying agents known to those skilled in the art. Examples of acidifying agents are organic acids such as citric acid and inorganic acids such as sulphuric acid.

Evaporation Reducing Ingredient

A first essential feature of the present invention is an ingredient reducing the evaporation of the solvent contained in liquid bleaching compositions comprising a peroxygen bleach. Said ingredient as described herein is used herein as a fabric protective agent in said compositions comprising a peroxygen bleach to treat fabrics, preferably pretreat fabrics, whereby colour fading and/or loss of tensile strength is reduced. Any ingredient reducing the evaporation of the solvent contained in said bleaching compositions having the desired property of solvent evaporation reduction may be used.

Preferred ingredients reducing the evaporation of the solvent contained in the bleaching compositions as described herein are high molecular weight homopolymers of acrylic acid and/or high molecular weight copolymers of acrylic acid and other comonomers, preferably alkyl acrylates. Said polymers are used as fabric protective agent in a liquid peroxygen bleach-containing composition to treat fabrics.

Typically, the compositions of the present invention comprise from 0.001% to 10%, preferably from 0.01% to 5%, more preferably from 0.05% to 3% and most preferably from 0.05% to 1% by weight of the total composition of a high molecular weight homopolymer of acrylic acid or a high molecular weight copolymer of acrylic acid and other comonomers, preferably alkyl acrylates, or a mixture thereof.

Suitable homopolymers of acrylic acid have a high molecular weight therefore, preferred homopolymers of acrylic acid for use herein have an average molecular weight of from $1*10^4$ to $1*10^8$, preferably from $1*10^5$ to $1*10^8$, and most preferably from $1*10^5$ to $1*10^7$.

Suitable copolymers of acrylic acid and other comonomers, preferably alkyl acrylates, have a high molecular weight therefore, preferred homopolymers of acrylic acid for use herein have an average molecular weight of from $1*10^4$ to $1*10^8$, preferably from $1*10^5$ to $1*10^8$, and most preferably from $1*10^5$ to $1*10^7$.

Preferred homopolymers of acrylic acid and copolymers of acrylic acid and other comonomers, preferably alkyl acrylates, are crosslinked or partially crosslinked, more preferably the homopolymers of acrylic acid and copolymers of acrylic acid and other comonomers, preferably alkyl acrylates, are crosslinked.

Suitable crosslinked homopolymers of acrylic acid and copolymers of acrylic acid and other comonomers are commercially available from BFGoodrich under the product names Carbopol® ETD 2020, Carbopol® ETD 2691, Carbopol® ETD 2623 or Carbopol® ETD 2001.

The present invention is based on the finding that fabric damage, more particularly colour fading and/or loss of tensile strength of the fabric fibers, is reduced, when bleaching compositions comprising a peroxygen bleach and an ingredient reducing the evaporation of the solvent contained in said bleaching compositions preferably a high molecular weight homopolymer of acrylic acid and/or a high molecular weight copolymer of acrylic acid and other comonomers, preferably alkyl acrylates, are used to treat, preferably pretreat, fabrics, preferably coloured fabrics and/or delicate fabrics as silk, wool and the like, as compared to the use of the same compositions but without an ingredient reducing the evaporation of the solvent contained in said bleaching compositions to treat, preferably pretreat, said fabrics.

Said ingredient reducing the evaporation of the solvent, e.g., water, from the compositions applied to fabrics during a laundry treatment process, preferably a laundry pretreatment process, will prevent or at least delay the liquid composition from drying on the fabrics. It is believed that by retaining at least a proportion of the solvent on the fabrics the concentration of peroxygen bleach on the fabric can be kept low. The result, as described in the 'background' section of the present application, is that radical decomposition of the peroxygen bleach on the fabric is reduced, further resulting in reduced fabric damage. In this instance reduced fabric damage is perceived in reduced colour fading and/or reduced loss of tensile strength.

By "reduced color fading", it is meant herein that the fading of the color of dyed fabrics that may occur when using the bleach-containing composition of the present invention is reduced or even prevented when compared to the color fading that occurs when using a peroxygen bleach-containing composition comprising a currently available fabric protective agent.

Colour safety can be evaluated visually by comparing side by side two fabrics where one has been pretreated with a composition of the present invention and the other has been treated with the reference composition. Differences and graduations in colour fading can be visually assessed and ranked according to Panel Score Units (PSU) using any suitable scale. PSU data can be handled statistically using conventional techniques. Alternatively, various types of optical apparatus and procedures can be used to assess the improvement in colour safety afforded by the present invention. For example when evaluating colour safety on fabrics measurements with Hunterlab colour Quest 45/0 apparatus can be used.

By "reduced loss of tensile strength", it is meant herein the damage to fabric fibres that may occur when using the bleach-containing compositions of the present is reduced or even prevented, when compared to the damage caused to fabric fibres that occurs when using a peroxygen bleach-containing composition comprising a currently available fabric protective agent.

The tensile strength of a fabric may be measured by stretching said fabric until it breaks. The force needed to break the fabric is the "Ultimate Tensile Stress" and may be measured with a stress-strain INSTRON® machine available from INSTRON. The loss of tensile strength is the difference between the tensile strength of a fabric taken as a reference, e.g., a newly manufactured fabric which is unwashed, and the tensile strength of the same fabric after having been bleached with a composition of the present invention. A tensile strength loss of zero means that no fabric damage is observed.

Another aspect of the present invention is the use in a peroxygen bleach-containing composition of an ingredient reducing the evaporation of the solvent contained in said composition to treat fabrics, whereby colour fading and/or loss of tensile strength is reduced.

Peroxygen Bleach

The ingredient reducing the evaporation of the solvent contained in bleaching composition of the present invention is used in a bleaching composition comprising a peroxygen bleach. Indeed, the presence of peroxygen bleach contributes to the excellent bleaching benefits of said compositions. Suitable peroxygen bleaches to be used herein are hydrogen peroxide, water soluble sources thereof, or mixtures thereof. As used herein a hydrogen peroxide source refers to any compound that produces perhydroxyl ions when said compound is in contact with water.

Suitable water-soluble sources of hydrogen peroxide for use herein include percarbonates, persilicates, persulphates such as monopersulfate, perborates, peroxyacids such as diperoxydodecandioic acid (DPDA), magnesium perphtalic acid, perlauric acid, perbenzoic and alkylperbenzoic acids, hydroperoxides, aliphatic and aromatic diacyl peroxides, and mixtures thereof. Preferred peroxygen bleaches herein are hydrogen peroxide, hydroperoxide and/or diacyl peroxide. Hydrogen peroxide is the most preferred peroxygen bleach herein.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide. Such hydroperoxides have the advantage to be particularly safe to fabrics and color while delivering excellent bleaching performance when used in any laundry application.

Suitable aliphatic diacyl peroxides for use herein are dilauroyl peroxide, didecanoyl peroxide, dimyristoyl peroxide, or mixtures thereof. Suitable aromatic diacyl peroxide for use herein is for example benzoyl peroxide. Such diacyl peroxides have the advantage to be particularly safe to fabrics and color while delivering excellent bleaching performance when used in any laundry application.

Typically, the compositions herein may comprise from 0.01% to 20%, preferably from 1% to 15% and more preferably from 1.5% to 10% by weight of the total composition of said peroxygen bleach.

Optional Ingredients

The compositions herein may further comprise a variety of other optional ingredients such as chelating agents, builders, surfactants, stabilisers, bleach activators, soil suspenders, soil suspending polyamine polymers, polymeric soil release agents, foam reducing systems, radical scavengers, catalysts, dye transfer agents, brighteners, perfumes, hydrotropes, pigments and dyes.

Surfactants

The compositions of the present invention may further comprise a surfactant including nonionic surfactants, zwitterionic surfactants, anionic surfactants, cationic surfactants and/or amphoteric surfactants.

Highly preferred compositions according to the present invention comprise a nonionic surfactant or a zwitterionic betaine surfactant or a mixture thereof.

Typically, the compositions according to the present invention may comprise from 0.01% to 30%, preferably from 0.1% to 25% and more preferably from 0.5% to 20% by weight of the total composition of a surfactant.

Suitable nonionic surfactants include alkoxylated nonionic surfactants. Preferred alkoxylated nonionic surfactants herein are ethoxylated nonionic surfactants according to the formula $RO—(C_2H_4O)_nH$, wherein R is a $C_6$ to $C_{22}$ alkyl chain or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains. Propoxylated nonionic surfactants and ethoxy/propoxylated ones may also be used herein instead of the ethoxylated nonionic surfactants as defined herein above or together with said surfactants.

Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol® 91-2.5 (HLB=8.1; R is a mixture of C9 and $C_{11}$ alkyl chains, n is 2.5), or Lutensol® TO3 (HLB=8; R is a $C_{13}$ alkyl chains, n is 3), or Lutensol® AO3 (HLB=8; R is a mixture of $C_{13}$ and $C_{15}$ alkyl chains, n is 3), or Tergitol® 25L3 (HLB=7.7; R is in the range of $C_{12}$ to $C_{15}$ alkyl chain length, n is 3), or Dobanol® 23-3 (HLB=8.1; R is a mixture of $C_{12}$ and $C_{13}$ alkyl chains, n is 3), or Dobanol® 23-2 (HLB=6.2; R is a mixture of $C_{12}$ and $C_{13}$ alkyl chains, n is 2), or Dobanol® 45-7 (HLB=11.6; R is a mixture of $C_{14}$ and $C_{15}$ alkyl chains, n is 7) Dobanol® 23-6.5 (HLB=11.9; R is a mixture of $C_{12}$ and $C_{13}$ alkyl chains, n is 6.5), or Dobanol® 25-7 (HLB=12; R is a mixture of $C_{12}$ and $C_{15}$ alkyl chains, n is 7), or Dobanol® 91-5 (HLB=11.6; R is a mixture of $C_9$ and $C_{11}$ alkyl chains, n is 5), or Dobanol® 91-6 (HLB=12.5; R is a mixture of $C_9$ and $C_{11}$ alkyl chains, n is 6), or Dobanol® 91-8 (HLB=13.7; R is a mixture of $C_9$ and $C_{11}$ alkyl chains, n is 8), Dobanol® 91-10 (HLB=14.2; R is a mixture of $C_9$ to $C_{11}$ alkyl chains, n is 10), Dobanol® 91-12 (HLB=14.5; R is a mixture of $C_9$ to $C_{11}$ alkyl chains, n is 12), or mixtures thereof. Preferred herein are Dobanol® 91-2.5, or Lutensol® TO3, or Lutensol® AO3, or Tergitol® 25L3, or Dobanol® 23-3, or Dobanol® 23-2, or Dobanol® 45-7, Dobanol® 91-8, or Dobanol® 91-10, or Dobanol® 91-12, or mixtures thereof. These Dobanol® surfactants are commercially available from SHELL. These Lutensol® surfactants are commercially available from BASF and these Tergitol® surfactants are commercially available from UNION CARBIDE.

Suitable chemical processes for preparing the alkoxylated nonionic surfactants for use herein include condensation of corresponding alcohols with alkylene oxide, in the desired proportions. Such processes are well known to the man skilled in the art and have been extensively described in the art.

The compositions herein may desirably comprise one of those ethoxylated nonionic surfactants or a mixture of those ethoxylated nonionic surfactants having different HLBs (hydrophilic-lipophilic balance). In a preferred embodiment the compositions herein comprise an ethoxylated nonionic surfactant according to the above formula and having an HLB up to 10 (i.e., a so called hydrophobic ethoxylated nonionic surfactant), preferably below 10, more preferably below 9, and an ethoxylated nonionic surfactant according to the above formula and having an HLB above 10 to 16 (i.e., a so called hydrophilic ethoxylated nonionic surfactant), preferably from 11 to 14. Indeed, in this preferred embodiment the compositions of the present invention typically comprise from 0.01% to 15% by weight of the total composition of said hydrophobic ethoxylated nonionic surfactant, preferably from 0.5% to 10% and from 0.01% to 15% by weight of said hydrophilic ethoxylated nonionic surfactant, preferably from 0.5% to 10%. Such mixtures of ethoxylated nonionic surfactants with different HLBs may be desired as they allow optimum grease cleaning removal performance on a broader range of greasy soils having different hydrophobic/hydrophilic characters.

Other suitable nonionic surfactants to be used herein include polyhydroxy fatty acid amide surfactants, or mixtures thereof, according to the formula:

$$R^2—C(O)—N(R^1)—Z,$$

wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2—(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2—(CHOH)_4—CH_2OH$.

In formula $R^2—C(O)—N(R^1)—Z$, $R^1$ can be, for example, N-methyl, N-ethyl, N-propyl, N-isopropyl, N-butyl, N-2-hydroxy ethyl, or N-2-hydroxy propyl. $R^2—C(O)—N<$ can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Suitable zwitterionic betaine surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulphonates, although other groups like sulfates, phosphonates, and the like can be used. A generic formula for the zwitterionic betaine surfactant to be used herein is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ sulphonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group, which is a carboxylate or sulphonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a—C(O)—NH—(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is $C_1$–$C_4$ sulphonate group, or a $C_1$–$C_3$ alkyl and more preferably methyl. Preferred $R_4$ is $(CH_2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or $C_{10}$–$C_{14}$ fatty acylamidopropylene(hydropropylene) sulfobetaine. For example $C_{10}$–$C_{14}$ fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Mirataine $H_2C$-HA®.

Suitable anionic surfactants to be used in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)SM), $C_{12}$–$C_{18}$ alkyl polyethoxylate (2.25) sulfate ($Cl_2$–$C_{18}$ E(2.25)SM), $C_{12}$–$C_{18}$ alkyl polyethoxylate (3.0) sulfate ($C_{12}$–$C_{18}$E(3.0)SM), and $C_{12}$–$C_{18}$ alkyl polyethoxylate (4.0) sulfate ($C_{12}$–$C_{18}$E(4.0) SM), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulphonates such as $C_{14-16}$ methyl ester sulphonates; acyl glycerol sulphonates, fatty oleyl glycerol sulfates, alkyl phenol ethylene oxide ether sulfates, paraffin sulphonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants to be used herein also include acyl sarcosinate or mixtures thereof, in its acid and/or salt form, preferably long chain acyl sarcosinates having the following formula:

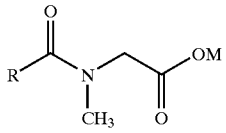

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Suitable amphoteric surfactants to be used herein include amine oxides having the following formula $R_1R_2R_3NO$ wherein each of $R_1$, $R_2$ and $R_3$ is independently a saturated substituted or unsubstituted, linear or branched hydrocarbon chains of from 1 to 30 carbon atoms. Preferred amine oxide surfactants to be used according to the present invention are amine oxides having the following formula $R_1R_2R_3NO$ wherein $R_1$ is an hydrocarbon chain comprising from 1 to 30 carbon atoms, preferably from 6 to 20, more preferably from 8 to 16, most preferably from 8 to 12, and wherein $R_2$ and $R_3$ are independently substituted or unsubstituted, linear or branched hydrocarbon chains comprising from 1 to 4 carbon atoms, preferably from 1 to 3 carbon atoms, and more preferably are methyl groups. R1 may be a saturated substituted or unsubstituted linear or branched hydrocarbon chain. Suitable amine oxides for use herein are for instance natural blend $C_8$–$C_{10}$ amine oxides as well as $C_{12}$–$C_{16}$ amine oxides commercially available from Hoechst.

Chelating Agents

The compositions of the present invention may comprise a chelating agent as a preferred optional ingredient. Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

A chelating agent may be desired in the compositions of the present invention as it allows to increase the ionic strength of the compositions herein and thus their stain removal and bleaching performance on various surfaces. The presence of chelating agents may also contribute to reduce the tensile strength loss of fabrics and/or color damage, especially in a laundry pretreatment application. Indeed, the chelating agents inactivate the metal ions present on the surface of the fabrics and/or in the cleaning compositions (neat or diluted) that otherwise would contribute to the radical decomposition of the peroxygen bleach.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer, have been extensively described in U.S. Pat. No. 4,704,233, Nov. 3, 1987, to Hartman and Perkins. Ethylenediamine N,N'-disuccinic acid is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Another chelating agent for use herein is of the formula:

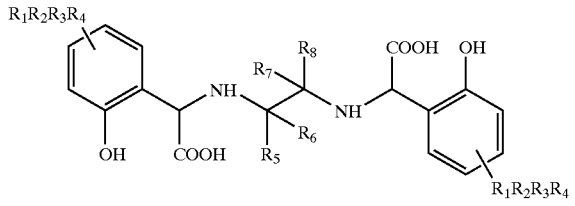

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention may comprise up to 5%, preferably from 0.01% to 1.5% by weight and more preferably from 0.01% to 0.5% by weight of the total composition of a chelating agent.

Foam Reducing System

The compositions according to the present invention may further comprise a foam reducing agent or a mixture thereof. Any foam reducing agents known to those skilled in the art are suitable for use herein. In a preferred embodiment a foam reducing system comprising a fatty acid together with a capped alkoxylated nonionic surfactant as defined herein after and/or silicone is used.

Typically, the compositions herein may comprise from $1\cdot10^{-4}$% to 10%, preferably from $1\cdot10^{-3}$% to 5% and more preferably from $1\cdot10^{-2}$% to 5% by weight of the total composition of a fatty acid.

Typically, the compositions herein may comprise from $1\cdot10^{-3}$% to 20%, preferably from $1\cdot10^{-2}$% to 10% and more preferably from $5\cdot10^{-2}$% to 5% by weight of the total composition of a capped alkoxylated nonionic surfactant as defined herein.

Typically, the compositions herein may comprise from $1\cdot10^{-5}$% to 5%, preferably from $1\cdot10^{-5}$% to 1% and more preferably from $1\cdot10^{-4}$% to 0.5% by weight of the total composition of a silicone.

Suitable fatty acids for use herein are the alkali salts of a $C_8$–$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms.

Suitable fatty acids may be selected from caprylic acid, capric acid, lauric acid, myristic acid, palmitic acid, stearic acid, and mixtures of fatty acids suitably hardened, derived from natural sources such as plant or animal esters (e.g., palm oil, coconut oil, soybean oil, castor oil, tallow, ground oil, whale and fish oils and/or babassu oil.

For example Coconut Fatty Acid is commercially available from UNICHEMA under the name PRIFAC 5900®.

Suitable capped alkoxylated nonionic surfactants for use herein are according to the formula:

$$R_1(O—CH_2—CH_2)_n—(OR_2)_m—O—R_3$$

wherein $R_1$ is a $C_8$–$C_{24}$ linear or branched alkyl or alkenyl group, aryl group, alkaryl group, preferably $R_1$ is a $C_8$–$C_{18}$ alkyl or alkenyl group, more preferably a $C_{10}$–$C_{15}$ alkyl or alkenyl group, even more preferably a $C_{10}$–$C_{15}$ alkyl group;

wherein $R_2$ is a $C_1$–$C_{10}$ linear or branched alkyl group, preferably a $C_2$–$C_{10}$ linear or branched alkyl group, preferably a $C_3$ group;

wherein $R_3$ is a $C_1$–$C_{10}$ alkyl or alkenyl group, preferably a $C_1$–$C_5$ alkyl group, more preferably methyl;

and wherein n and m are integers independently ranging in the range of from 1 to 20, preferably from 1 to 10, more preferably from 1 to 5; or mixtures thereof.

These surfactants are commercially available from BASF under the trade name Plurafac®, from HOECHST under the trade name Genapol® or from ICI under the trade name Symperonic®. Preferred capped nonionic alkoxylated surfactants of the above formula are those commercially available under the tradename Genapol® L 2.5 NR from Hoechst, and Plurafac® from BASF.

Suitable silicones for use herein include any silicone and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the silicone is advantageously releasably incorporated in a water-soluble or water-dispersible, substantially non-surface-active detergent impermeable carrier. Alternatively, the silicone can be dissolved or dispersed in a liquid carrier and applied by spraying on to one or more of the other components.

Actually in industrial practice, the term "silicone" has become a generic term which encompasses a variety of relatively high-molecular-weight polymers containing siloxane units and hydrocarbyl groups of various types. Indeed, silicone compounds have been extensively described in the art, see for instance U.S. Pat. Nos. 4,076,648, 4,021,365, 4,749,740, 4,983,316, EP 150 872, EP 217 501 and EP 499 364. The silicone compounds disclosed therein are suitable in the context of the present invention. Generally, the silicone compounds can be described as siloxanes having the general structure:

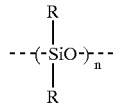

wherein n is from 20 to 2000, and where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end blocking units and having a viscosity at 25° C. of from $5\times10^{-5}$ $m^2/s$ to 0.1 $m^2/s$, i.e., a value of n in the range 40 to 1500. These are preferred because of their ready availability and their relatively low cost.

A preferred type of silicone compounds useful in the compositions herein comprises a mixture of an alkylated siloxane of the type herein above disclosed and solid silica.

The solid silica can be a fumed silica, a precipitated silica or a silica made by the gel formation technique. The silica particles can be rendered hydrophobic by treating them with diakylsilyl groups and/or trialkylsilane groups either bonded directly onto the silica or by means of silicone resin. A preferred silicone compound comprises a hydrophobic silanated, most preferably trimethylsilanated silica having a particle size in the range from 10 mm to 20 mm and a specific surface area above 50 $m^2/g$. Silicone compounds employed in the compositions according to the present invention suitably have an amount of silica in the range of 1 to 30% (more preferably 2.0 to 15%) by weight of the total weight of the silicone compounds resulting in silicone compounds having an average viscosity in the range of from $2\times10^{-4}m^2/s$ to 0.1 $m^2/s$. Preferred silicone compounds may have a viscosity in the range of from $5\times10^{-3}m^2/s$ to 0.1 $m^2/s$. Particularly suitable are silicone compounds with a viscosity of $2\times10^{-2}$ $m^2/s$ or $4.5\times10^{-2}$ $m^2/s$.

Suitable silicone compounds for use herein are commercially available from various companies including Rhone Poulenc, Fueller and Dow Corning. Examples of silicone compounds for use herein are Silicone DB® 100 and Silicone Emulsion 2-3597® both commercially available from Dow Corning.

Another silicone compound is disclosed in Bartollota et al. U.S. Pat. No. 3,933,672. Other particularly useful silicone compounds are the self-emulsifying silicone compounds, described in German Patent Application DTOS 2 646 126 published Apr. 28, 1977. An example of such a compound is DC-544®, commercially available from Dow Corning, which is a siloxane-glycol copolymer.

Typically preferred silicone compounds are described in European Patent application EP-A-573699. Said compositions can comprise a silicone/silica mixture in combination with fumed nonporous silica such as Aerosil®.

Radical Scavenger

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl)butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®. Radical scavengers when used, are typically present herein in amounts ranging from up to 10% and preferably from 0.001% to 0.5% by weight of the total composition.

The presence of radical scavengers may contribute to reduce tensile strength loss of fabrics and/or color damage when the compositions of the present invention are used in any laundry application, especially in a laundry pretreatment application.

Antioxidant

The compositions according to the present invention may further comprise an antioxidant or mixtures thereof. Typically, the compositions herein may comprise up to 10%, preferably from 0.002% to 5%, more preferably from 0.005% to 2%, and most preferably from 0.01% to 1% by weight of the total composition of an antioxidant.

Suitable antioxidants to be used herein include organic acids like citric acid, ascorbic acid, tartaric acid, adipic acid and sorbic acid, or amines like lecithin, or aminoacids like glutamine, methionine and cysteine, or esters like ascorbil palmitate, ascorbil stearate and triethylcitrate, or mixtures thereof. Preferred antioxidants for use herein are citric acid, ascorbic acid, ascorbil palmitate, lecithin or mixtures thereof.

Bleach Activator

As an optional ingredient, the compositions of the present invention may comprise a bleach activator or mixtures thereof. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition. The compositions according to the present invention may comprise from 0.01% to 20%, preferably from 1% to 10%, and more preferably from 3% to 7% by weight of the total composition of said bleach activator.

Treating Processes

In the present invention, the liquid bleaching composition of the present invention needs to be contacted with the fabrics to be treated.

By "fabrics", it is meant herein any type of fabrics including clothes, curtains, drapes, bed linens, bath linens, table cloths, sleeping bags, tents, upholstered furniture and the like, and carpets. Fabrics to be treated as described herein include natural fabrics (e.g., fabrics made of cotton, viscose, linen, silk and wool), synthetic fabrics such as those made of polymeric fibers of synthetic origin as well as those made of both natural and synthetic fibers.

In a preferred embodiment according to the present invention the fabrics treated are coloured fabrics, i.e., the fibres of the fabric have been dyed.

In another preferred embodiment the fabrics treated are delicate fabrics such as wool, silk and the like. In an even more preferred embodiment the fabrics are wool or silk.

In the process according to the present invention a composition, as defined herein, is contacted with the fabrics to be treated in a so-called "pretreatment mode", where a composition, as defined herein, is applied neat onto said fabrics before the fabrics are rinsed, or washed then rinsed.

By "treating" it is meant herein, cleaning, as the composition according to the present invention provides excellent stain removal performance on a broad range of stains and soils and on various fabrics, as well as bleaching, as the composition according to the present invention provides excellent bleach performance due mainly to the presence of the peroxygen bleach.

By "washing", it is to be understood herein that the fabrics are contacted with a conventional detergent composition comprising at least one surface active agent in an aqueous bath, this washing may occur by means of a washing machine or simply by hands.

By "in its neat form", it is to be understood that the liquid compositions are applied directly onto the fabrics to be pretreated without undergoing any dilution, i.e., the liquid compositions herein are applied onto the fabrics as described herein.

In the pretreatment mode, the process comprises the steps of applying said liquid composition in its neat form onto said fabrics, or at least soiled portions thereof, and subsequently rinsing, or washing then rinsing said fabrics. In this mode, the neat compositions can optionally be left to act onto said fabrics for a prolonged period of time, before the fabrics are rinsed, or washed then rinsed, preferably provided that the composition is not left to dry onto said fabrics. For particularly though stains, it may be appropriate to further rub or brush said fabrics by means of a sponge or a brush, or by rubbing two pieces of fabrics against each other.

Depending on the end-use envisioned, the compositions herein can be packaged in a variety of containers including conventional bottles, bottles equipped with roll-on, sponge, brusher or sprayers.

The invention is further illustrated by the following examples.

EXAMPLES

Following compositions were made by mixing the listed ingredients in the listed proportions (weight % unless otherwise specified).

| | Compositions | | | | | | | |
|---|---|---|---|---|---|---|---|---|
| | I | II | III | IV | V | VI | VII | VIII |
| Dobanol ® 23-3 | 1.0 | 2.0 | 1.0 | 2.0 | 2.0 | 1.0 | 2.0 | 1.0 |
| Dobanol ® 45-7 | 3.0 | 1.5 | 3.0 | 1.5 | — | 3.0 | 1.5 | 3.0 |
| Dobanol ® 91-8 | — | — | — | — | 1.0 | — | — | — |
| Dobanol ® 91-10 | — | — | — | — | 1.0 | — | — | — |
| Alkyl betaine | — | — | — | — | — | 2.5 | 2.5 | 2.0 |
| Hydrogen Peroxide | 7.0 | 7.0 | 8.0 | 9.0 | 7.0 | 7.0 | 8.0 | 6.0 |
| Carbopol ® ETD 2623 | 0.1 | 0.2 | 0.01 | 0.8 | 0.3 | 0.5 | 0.4 | 0.4 |
| Water and minors | ----------up to 100%---------- | | | | | | | |
| | IX | X | XI | XII | XIII | XIV | XV | XVI |
| Hydrogen Peroxide | 7.0 | 7.0 | 8.0 | 9.0 | 7.0 | 7.0 | 8.0 | 6.0 |
| Carbopol ® ETD 2691 | — | 0.3 | 0.5 | — | — | 0.8 | 0.2 | 1.0 |
| Carbopol ® ETD 2623 | 0.5 | 0.1 | — | 0.3 | 0.8 | — | 0.3 | — |
| Water and minors | ----------up to 100%---------- | | | | | | | |

All examples have a pH of up to 9

Dobanol ® 23-3 is a $C_{12}$–$C_{13}$ EO3 nonionic surfactant commercially available from SHELL.

Dobanol ® 45-7 is a $C_{14}$–$C_{15}$ EO7 nonionic surfactant commercially available from SHELL.

Dobanol ® 91-8 is a $C_9$–$C_{11}$ EO8 nonionic surfactant commercially available from SHELL.

Dobanol ® 91-10 is a $C_9$–$C_{11}$ EO10 nonionic surfactant commercially available from SHELL.

Alkyl betaine is Lauryl di-methyl betaine commercially available by Hoechst under the trade name GENAGEN. LAB ®.

Carbopol ® ETD 2691 is commercially available from BFGoodrich.

Carbopol ® ETD 2623 is commercially available from BFGoodrich.

Hydrogen Peroxide is commercially available from Ausimont.

All the above compositions show good loss of tensile strength prevention and/or good color safety when used to treat, preferably pretreat, fabrics.

What is claimed is:

1. A process of treating a fabric which comprises the step of contacting said fabric with a bleaching composition, in its neat form, wherein said bleaching composition comprises a peroxygen bleach and a high molecular weight polymer selected from the group consisting of a homopolymer of acrylic acid having a molecular weight of from $1\times10^5$ to $1\times10^8$, copolymers of acrylic acid having a molecular weights of from $1\times10^5$ to $1\times10^8$ and mixtures thereof.

2. A process according to claim 1 wherein said fabrics are coloured.

3. A process according to claim 1 wherein said fabrics are delicate fabrics.

4. A process according to claim 1 wherein said high molecular weight polymer is crosslinked or partially crosslinked.

5. A process according to claim 1 wherein said bleaching compositions comprises from 0.001% to 10% by weight of the total composition of said high molecular weight polymer.

6. A process or the use according to claim 1 wherein said high molecular weight polymer has a molecular weight of from $\mathbf{1\times10^5}$ to $1\times10^7$.

7. A process according to claim 1 wherein said peroxygen bleach is hydrogen peroxide or a water soluble source thereof.

8. A process according to claim 1 wherein said solvent is water.

9. A process according to claim 1 wherein said bleaching composition comprises from 0.01% to 20% by weight of the total composition of said peroxygen bleach.

10. A process according to claim 1 wherein said bleaching composition further comprises a surfactant.

11. A process according to claim 10 wherein said surfactant is a nonionic surfactant or a zwitterionic betaine surfactant or a mixture thereof.

12. A method of reducing the evaporation of a solvent contained in a peroxygen bleach-containing composition, said method comprising combining a high molecular weight polymer selected from the group consisting of a homopolymer of acrylic acid having a molecular weight of from $1\times10^5$ to $1\times10^8$, copolymers of acrylic acid having a molecular weights of from $1\times10^5$ to $1\times10^8$ and mixtures thereof with said peroxygen bleach-containing composition.

* * * * *